US009682273B2

(12) United States Patent
Huang

(10) Patent No.: US 9,682,273 B2
(45) Date of Patent: Jun. 20, 2017

(54) EXERCISE BIASED WEIGHT

(71) Applicant: Sheng Hsiung Tony Huang, South Pasadena, CA (US)

(72) Inventor: Sheng Hsiung Tony Huang, South Pasadena, CA (US)

( * ) Notice: Subject to any disclaimer, the term of this patent is extended or adjusted under 35 U.S.C. 154(b) by 189 days.

(21) Appl. No.: 14/485,781

(22) Filed: Sep. 14, 2014

(65) Prior Publication Data

US 2016/0074694 A1 Mar. 17, 2016

(51) Int. Cl.
*A63B 21/00* (2006.01)
*A63B 21/072* (2006.01)
*A63B 21/075* (2006.01)

(52) U.S. Cl.
CPC ..... *A63B 21/0728* (2013.01); *A63B 21/075* (2013.01); *A63B 21/0724* (2013.01); *A63B 21/0726* (2013.01)

(58) Field of Classification Search
CPC ..... A63B 21/00
USPC ..... 482/106, 108, 109, 107
See application file for complete search history.

(56) References Cited

U.S. PATENT DOCUMENTS 2,291,098 A * 7/1942 Myers ..... D05B 71/02 112/184
5,509,877 A * 4/1996 Adams ..... A63B 21/072 482/108
D394,685 S * 5/1998 Eckmann ..... D21/680
7,264,578 B1 * 9/2007 Krull ..... A63B 21/0728 482/107
2008/0113851 A1 * 5/2008 Lien ..... A63B 21/06 482/106

* cited by examiner

*Primary Examiner* — Jerome w Donnelly
(74) *Attorney, Agent, or Firm* — Raymond Y. Chan; David and Raymond Patent Firm

(57) ABSTRACT

An exercise biased weight includes a weight body defining a center of mass and a through offset bore formed at the weight body at a position offset to the center of mass thereof, wherein a diameter of the offset bore is slightly larger than a diameter of a weight bar member for enabling the weight bar member to slidably pass through the offset bore so as to retain the weight body at the weight bar member. Therefore, the weight body is lifted to generate a downward weight force to against an unwanted shaking movement of the weight body.

3 Claims, 5 Drawing Sheets

EXERCISE BIASED WEIGHT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an exercise weight, and more particularly to an exercise biased weight, which has an offset bore located offset a center of mass of the exercise biased weight to generate a downward weight force to against an unwanted shaking movement of the weight body when the exercise biased weight is lifted.

Description of Related Arts

Fitness has been a dramatically growth industry during the past decades. In particular, weight training becomes a common type of strength training to build up muscle and promote personal confident. At first, trainers used their physical body to achieve the physical training, such as push-up and sit-ups, in such a manner that the trainers exert an offset force against their personal weight to train their muscle. In order to promote the training result, a variety of exercise apparatus have been provided in the current market to meet the needs of the growing population of the people who is keen to physical fitness activities. Trainers use exercise bands incorporated with their body to tone their muscle, such that the equipment required is inexpensive and they can packs their exercise bands when traveling and work out wherever they want. However, those exercise bands are difficult to measure how much weight to be added on the trainer's body.

Barbell is another typical equipment for training the muscle. Trainers can selectively add or subtract weight plates on/from the barbell bar so as to adjust their training purposes. In other words, the barbell is a weight-adjustable structure. Although this training equipment is easy for the trainer to record their training process, loading weight plates on the barbell is usually a technique problem. Each circular weight plate has a center hole for inserting the barbell bar thereinto, wherein since the circular weight plate has its center of mass at the center thereof, the center hole will be located at the same spot of the center of mass of the weight plate. Therefore, when the barbell is inserted into the center hole of the weight plate, the center of the mass of the weight plate is located at the barbell bar. In order to smoothly insert the barbell bar into the center hole, the diameter of the center hole must be larger than the diameter of the barbell bar. Otherwise, the barbell cannot be inserted through the center hole. As a result, a clearance is formed between the inner circumferential surface of the center hole of the weight plate and the outer circumferential surface of the barbell bar. Accordingly, there are some common drawbacks for the weight-adjustable barbell structure.

The center hole of the weight plate at the center of mass thereof will cause unwanted vibration at the barbell during training. For example, when the trainers lift the barbell by two hands, the unbalanced lifting forces at two hands will exert to the barbell and cause the weight plates to shake easily. In order to overcome a shaking force generated between the barbell bar and the weight plates, the trainers must keep the lifting force in balance by twisting their wrists. In other words, the weight force of the weight plate will transfer to the wrists of the trainer but not the arms thereof. The excessive weight of the weight plates will cause injuries on the trainers' wrists.

In addition, the weight plates are circular plates, so that when the barbell is dropped on the ground with the weight plates placed thereon, the center of mass of the weight plate will shift accordingly. In other words, the barbell will serve as a rotating axle that the weight plates will roll on the ground.

Furthermore, due to the location of the center hole of the weight plate, the usage area of the weight plate will be limited. If the manufacturers need to put their aesthetic design or logo on the weight plate, the size and orientation thereof will be limited to the peripheral portion of the weight plate.

SUMMARY OF THE PRESENT INVENTION

A main object of the present invention is to provide an exercise biased weight, wherein a through offset bore formed at the weight body at a position offset to the center of mass thereof, such that the weight body is lifted to generate a downward weight force to against an unwanted shaking movement of the weight body.

Another object of the present invention is to provide the exercise biased weight, wherein the weight body is formed in circular shape, such that the weight body can fit to any existing weight bar member.

Another object of the present invention is to provide the exercise biased weight, wherein the offset bore is located at an off-center of the weight body, such that the center of mass of the weight body is located below the location where the offset bore located is when the weight body is lifted.

Another object of the present invention is to provide the exercise biased weight, wherein the weight body has a light weight segment and a heavy weight segment to form the offset bore at the center of the weight body.

Another object of the present invention is to provide the exercise biased weight, wherein the light weight segment and the heavy weight segment can be made of the same material or different materials to create a weight difference between the light weight segment and the heavy weight segment.

Another object of the present invention is to provide the exercise biased weight, which does not require to alter the original structural design of the weight training equipment having a weight bar member, so as to minimize the manufacturing cost of the weight body incorporating with the weight training equipment.

Another object of the present invention is to provide the exercise biased weight, wherein no expensive and complicated structures are required to be employed in the present invention in order to achieve the above mentioned objects. Therefore, the present invention successfully provides an economic and efficient solution that generates the downward weight force to against the shaking force so as to balance the exercise biased weight securely equipped with the weight training equipment.

According to the present invention, the foregoing and other objects and advantages are attained by an exercise biased weight, comprising a weight body defining a center of mass, and a through offset bore formed at the weight body at a position offset to the center of mass thereof, wherein a diameter of the offset bore is slightly larger than a diameter of the weight bar member for enabling the weight bar member to slidably pass through the offset bore so as to retain the weight body at the weight bar member. Therefore, the weight body is lifted to generate a downward weight force to against an unwanted shaking movement of the weight body.

In accordance with another aspect of the invention, the present invention comprises a weight training equipment, comprising a weight bar member and a plurality of exercise biased weights selectively coupled at the weight bar member to adjust a weight loading force thereat.

Additional advantages and features of the invention will become apparent from the description which follows, and may be realized by means of the instrumentalities and combinations particular point out in the appended claims.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
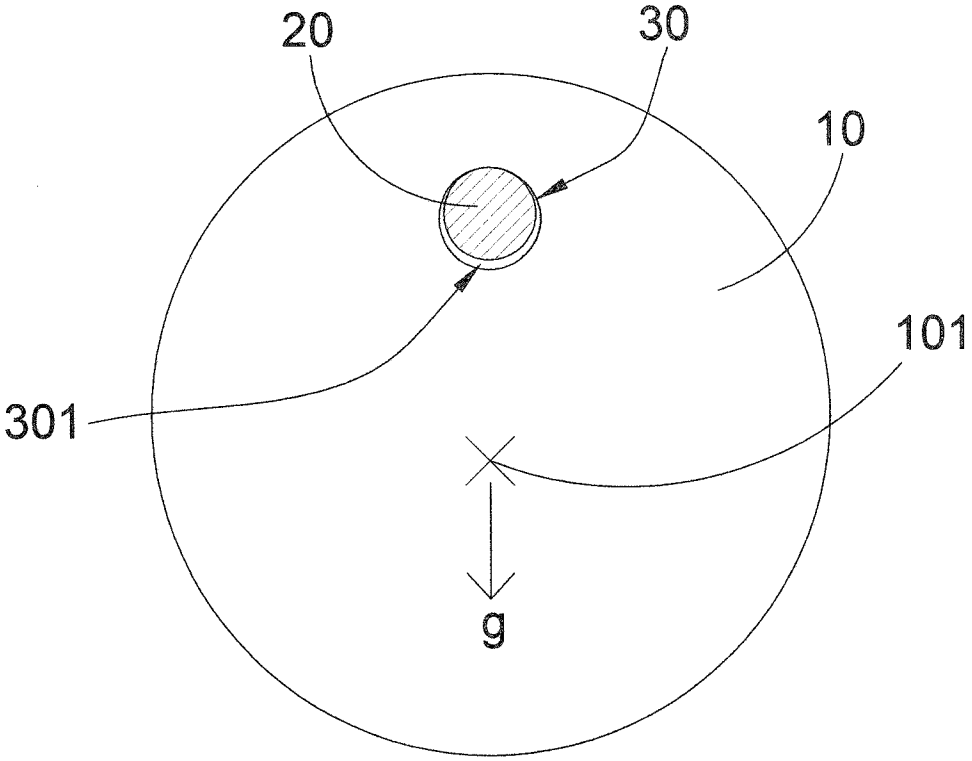
FIG. 1 is a perspective view of an exercise biased weight according to a first preferred embodiment of the present invention, illustrating a weight bar member passing through an offset bore of a weight body when the weight body is lifted.
Figure 2:
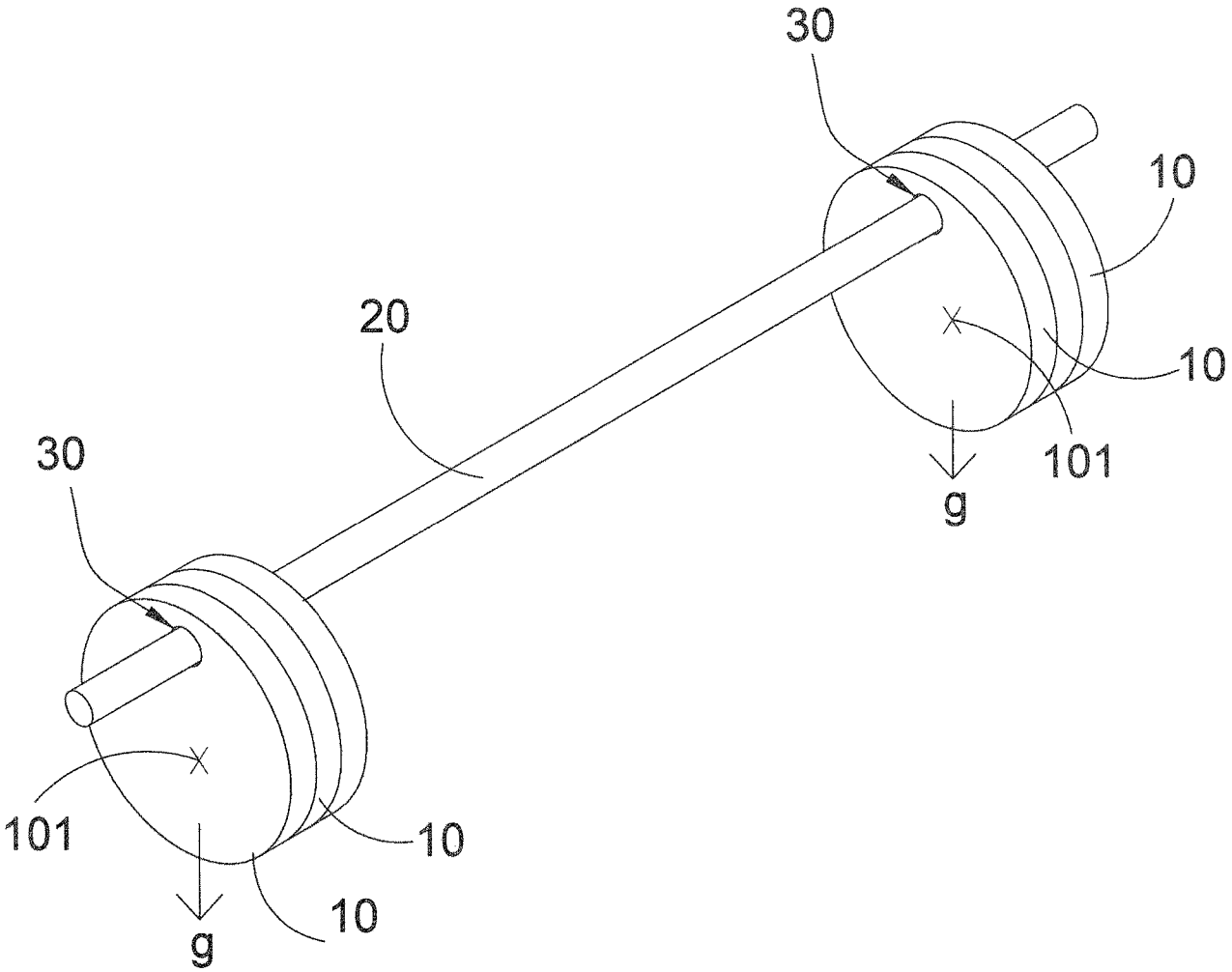
FIG. 2 is a perspective view of the exercise biased weight according to the above first preferred embodiment of the present invention, illustrating a plurality of exercise biased weights equipped with the weight training equipment.

Referring to FIG. 1 to FIG. 2 of the drawings, an exercise biased weight according to a first preferred embodiment of the present invention is illustrated, wherein the exercise biased weight is adapted to incorporate with a weight training equipment, such barbell system or workbench system, having a weight bar member 20.

According to the preferred embodiment, the exercised biased weight comprises a weight body 10 defining a center of mass 101, and a through offset bore 30 formed at the weight body 10 at a position offset to the center of mass 101 thereof. In particular, a diameter of the offset bore 30 is slightly larger than a diameter of the weight bar member 20 for enabling the weight bar member 20 to slidably pass through the offset bore 30 so as to retain the weight body 10 at the weight bar member 20.

As shown in FIG. 1, the weight body 10 can be cast or rubber coated to provide a predetermined weight. The weight body 10 has a disc-shape or circular shape with two opposed planar surfaces to define a thickness therebetween. Preferably, the center of mass 101 is located at a center portion of the weight body 10.

The offset bore 30 is a circular through hole formed at an off-center of the weight body 10 and extended through the planar surfaces thereof. In particular, the offset bore 30 is located at the weight body 10 above the center of mass 101 of the weight body 10 when the weight body 10 is lifted, as shown in FIG. 1. Accordingly, since the diameter of the offset bore 30 is larger than the diameter of the weight bar member 20, a clearance 301 is formed between an inner circumferential surface of the offset bore 30 and an outer circumferential surface of the weight bar member 20. In other words, when the weight body 10 is lifted, the weight bar member 20 at the offset bore 30 is located above the center of mass 101 of the weight body 10. Therefore, the weight body 10 is lifted to generate a downward weight force g by gravity to against an unwanted shaking movement of the weight body 10. In other words, when the weight body 10 is lifted, the shaking movement of the weight body 10 must overcome the downward weight force g thereof. As a result, the shaking movement of the weight body 10 will be minimized due to the downward weight force g. It is worth mentioning that when the weight body 10 is dropped on the ground, the downward weight force g will pull the weight body 10 toward the ground so as to prevent the weight body 10 being rolled on the ground.

Since the offset bore 30 is not located at the center of the weight body 10, the usage area on each planar surface of the weight body 10 will not be limited by the offset bore 30. Therefore, the manufacturers can put their aesthetic design or logo on the weight plate 10 at the center portion thereof without any limitation of the size and orientation of the design or logo.

FIG. 2 illustrates the barbell system, wherein a plurality of exercise biased weights are selectively coupled at the weight bar member 20 to adjust the weight loading force thereat. For example, three pairs of weight bodies 10 are coupled at two end portions of the weight bar member 20 through the offset bores 30.

It is worth mentioning that the exercise biased weight according to the preferred embodiment of the present invention can be incorporated with the existing workbench system, wherein the exercise biased weights are selectively coupled at the weight bar member 20 through the offset bores 30 to select the amount of resistance applied during the exercise.

Figure 3:
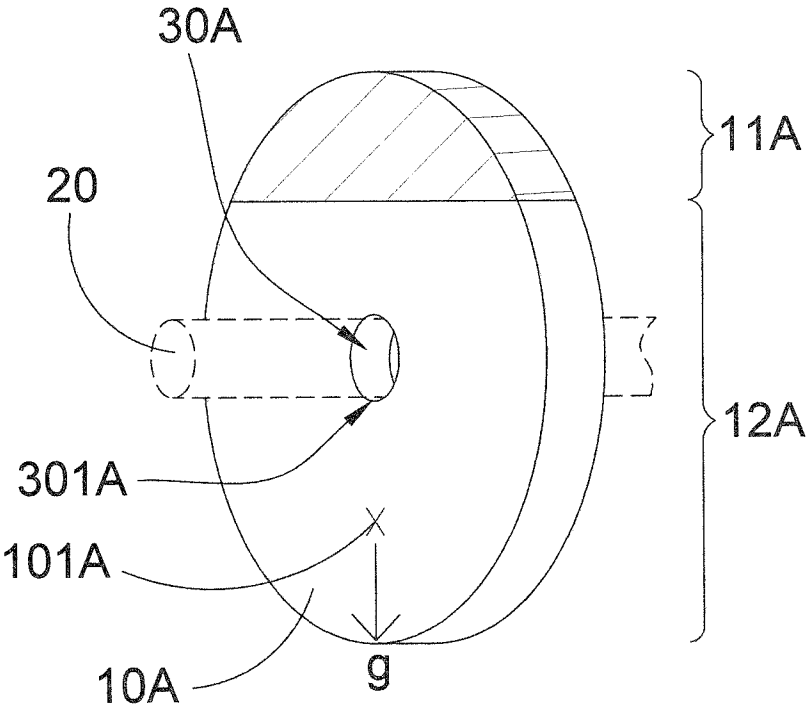
FIG. 3 is a perspective view of an exercise biased weight according to a second preferred embodiment of the present invention, illustrating the light weight segment and the heavy weight segment.

As shown in FIG. 3, an exercised biased weight according to a second embodiment illustrates an alternative mode of the first embodiment, wherein the exercised biased weight comprises a weight body 10A defining a center of mass 101A, and a through offset bore 30A formed at the weight body 10A at a position offset to the center of mass 101A thereof. Likewise, the diameter of the offset bore 30A is slightly larger than a diameter of the weight bar member 20 for enabling the weight bar member 20 to slidably pass through the offset bore 30A so as to retain the weight body 10A at the weight bar member 20.

As shown in FIG. 3, the weight body 10A can be cast or rubber coated to provide a predetermined weight. The weight body 10A has a disc-shape or circular shape with two opposed planar surfaces to define a thickness therebetween. Preferably, the center of mass 101A is located at a center of the weight body 10A.

The weight body 10A has a light weight segment 11A and a heavy weight segment 12A, wherein the light weight segment 11A is lighter than the heavy weight segment 12A.

In particular, a volume of light weight segment 11A is smaller than a volume of the heavy weight segment 12A.

According to the second embodiment, the light weight segment 11A and the heavy weight segment 12A are made of different materials. For example, the light weight segment 11A can be made of plastic and the heavy weight segment 12A can be made of metal.

The offset bore 30A is a circular through hole formed at a center of the weight body 10A and extended through the planar surfaces thereof. Accordingly, the center of mass 101A of the weight body 10A is located at the heavy weight segment 12A thereof, wherein the offset bore 30A is formed at the heavy weight segment 12A and is located apart from the center of mass 101A of the weight body 10A. In particular, the offset bore 30A is located at the weight body 10A above the center of mass 101A of the weight body 10A when the weight body 10A is lifted. Therefore, a clearance 301A is formed between an inner circumferential surface of the offset bore 30A and an outer circumferential surface of the weight bar member 20. As a result, the weight body 10A is lifted to generate a downward weight force g by gravity to against an unwanted shaking movement of the weight body 10A.

Figure 4:
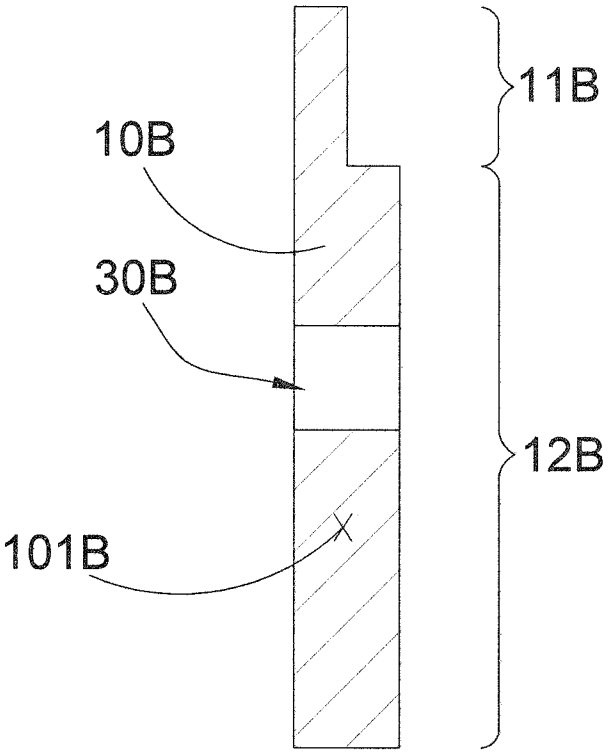
FIG. 4 is a first alternative mode of the weight body of the exercise biased weight according to the above second preferred embodiment of the present invention.

FIG. 4 illustrates a first alternative mode of the exercised biased weight according to the second embodiment, wherein the weight body 10B has a light weight segment 11B and a heavy weight segment 12B. The light weight segment 11B is lighter than the heavy weight segment 12B. A volume of light weight segment 11B is smaller than a volume of the heavy weight segment 12B. Accordingly, the light weight segment 11B and the heavy weight segment 12B are made of the same material and are integrated with each other to form a unified body. In particular, a thickness of the light weight segment 11B is smaller than a thickness of the heavy weight segment 12B, such that the light weight segment 11B is lighter than the heavy weight segment 12B. Preferably, each of the light weight segment 11B and the heavy weight segment 12B has a uniform thickness. It is appreciated that the thickness of the light weight segment 11B is gradually reduced from the heavy weight segment 12B while the heavy weight segment 12B has a uniform thickness.

The offset bore 30B is a circular through hole formed at a center of the weight body 10B and extended through the planar surfaces thereof. Accordingly, the center of mass 101B of the weight body 10B is located at the heavy weight segment 12B thereof, wherein the offset bore 30B is formed at the heavy weight segment 12B and is located apart from the center of mass 101B of the weight body 10B. Therefore, the offset bore 30B is located at the weight body 10B above the center of mass 101B of the weight body 10B when the weight body 10B is lifted.

Figure 5:
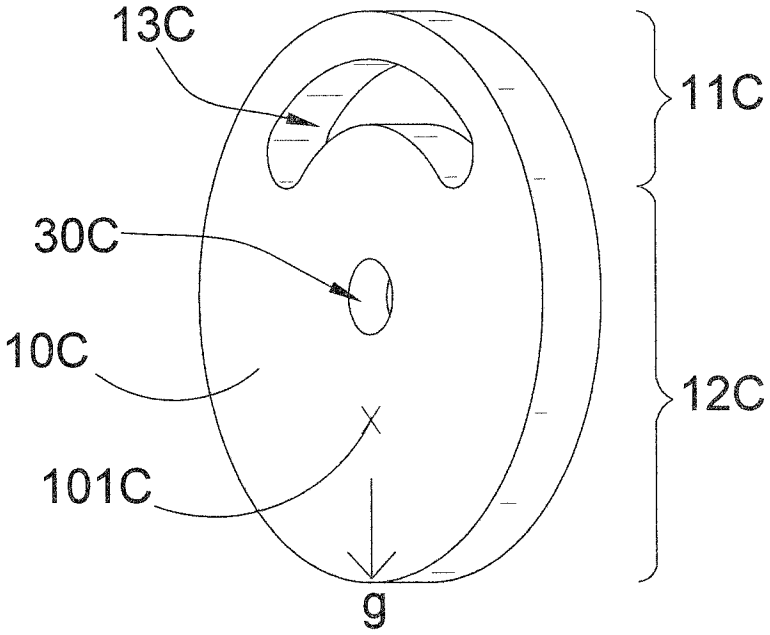
FIG. 5 is a second alternative mode of the weight body of the exercise biased weight according to the above first preferred embodiment of the present invention.

FIG. 5 illustrates a second alternative mode of the exercised biased weight according to the second embodiment, wherein the weight body 10C has a light weight segment 11C and a heavy weight segment 12C. The light weight segment 11C is lighter than the heavy weight segment 12C. Accordingly, the light weight segment 11C and the heavy weight segment 12C are made of the same material and are integrated with each other to form a unified body.

In particular, the weight body 10C further has a through slot 13C formed at the light weight segment 11C, such that the light weight segment 11C is lighter than the heavy weight segment 12C. As shown in FIG. 5, the through slot 13C is an arc-slot formed at the light weight segment 11C of the weight body 10C.

The offset bore 30C is a circular through hole formed at a center of the weight body 10C and extended through the planar surfaces thereof. Accordingly, the center of mass 101C of the weight body 10C is located at the heavy weight segment 12C thereof, wherein the offset bore 30C is formed at the heavy weight segment 12C and is located apart from the center of mass 101C of the weight body 10C. Therefore, the offset bore 30C is located at the weight body 10C above the center of mass 101C of the weight body 10C when the weight body 10C is lifted.

According to the above embodiments and their alternative modes, the offset bore is located above the center of mass of the weight body when the weight body is lifted. Therefore, the weight body is lifted to generate the downward weight force to against the unwanted shaking movement of the weight body so as to minimize the unwanted shaking movement of the weight body during training. In addition, the exercise biased weight of the present invention fits to any existing weight training equipment having the weight bar member, such that the exercise biased weight of the present invention can be a replacement of the conventional weight plate to put the exercise biased weight of the present invention on the existing weight training equipment.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An exercise biased weight for a weight bar member, comprising:

a weight body defining a center of mass, wherein said weight body, which is formed in a circular shape, has a light weight segment and a heavy weight segment that the center of mass of said weight body is located at said heavy weight segment, wherein said light weight segment and said heavy weight segment are made of different materials; and a through offset bore formed at said weight body at a position offset to the center of mass thereof, wherein a diameter of said offset bore is slightly larger than a diameter of said weight bar member for enabling said weight bar member to slidably pass through said offset bore so as to retain said weight body at said weight bar member, wherein said offset bore is formed at said heavy weight segment and is located apart from the center of mass of said weight body.

2. An exercise biased weight for a weight bar member, comprising:

a weight body defining a center of mass, wherein said weight body, which is formed in a circular shape, has a light weight segment and a heavy weight segment that the center of mass of said weight body is located at said heavy weight segment, wherein a volume of said light weight segment is smaller than a volume of said heavy weight segment, wherein said light weight segment and said heavy weight segment are made of different materials; and a through offset bore formed at said weight body at a position offset to the center of mass thereof, wherein a diameter of said offset bore is slightly larger than a diameter of said weight bar member for enabling said weight bar member to slidably pass through said offset bore so as to retain said weight body at said weight bar member, wherein said offset bore is formed at said heavy weight segment and is located at a center of said weight body and apart from the center of mass of said weight body.

3. A weight training equipment, comprising:

a weight bar member; and a plurality of exercise biased weights selectively coupled at said weight bar member to adjust a weight loading force thereat, wherein each of said exercise biased weights comprises a weight body defining a center of mass, and a through offset bore formed at said weight body at a position offset to the center of mass thereof, wherein a diameter of said offset bore is slightly larger than a diameter of said weight bar member, such that said weight bar member slidably passes through said offset bore to retain said weight body at said weight bar member, wherein each of said weight bodies, which is formed in a circular shape, has a light weight segment and a heavy weight segment that the center of mass of said weight body is located at said heavy weight segment, wherein said offset bore is formed at said heavy weight segment and is located apart from the center of mass of said weight body, wherein said offset bore is located at a center of said weight body and a volume of said light weight segment is smaller than a volume of said heavy weight segment, wherein said light weight segment and said heavy weight segment are made of different materials.

* * * * *